US005642565A

United States Patent [19]

Tovar Riestra

[11] Patent Number: 5,642,565

[45] Date of Patent: Jul. 1, 1997

[54] HAND PROPELLED LONGITUDINAL AXIAL GYROSCOPIC PROJECTILE

[76] Inventor: Francisco Tovar Riestra, Camino Real, s/n, 36600 Villagarcia de Arosa, Spain

[21] Appl. No.: 529,584

[22] Filed: Sep. 18, 1995

[30] Foreign Application Priority Data

Dec. 15, 1994 [ES] Spain ..... 9402558

[51] Int. Cl.[6] ..... A63B 65/02

[52] U.S. Cl. ..... 30/123; 30/296.1; 473/578

[58] Field of Search ..... 30/165, 298, 296.1, 30/358, 359, 366, 367, 368, 164.5, 164.7, 164.8, 123; 273/416; D22/100, 102, 115, 117, 118

[56] References Cited

U.S. PATENT DOCUMENTS 1,520,670 12/1924 Appel ..... 30/164.5

3,957,271 5/1976 Kurtz et al. ..... 273/416

4,608,757 9/1986 Eckerle ..... 30/299

5,197,745 3/1993 Whiteley ..... 30/123

*Primary Examiner*—Hwei-Siu Payer

*Attorney, Agent, or Firm*—Ostrolenk, Faber, Gerb & Soffen, LLP

[57] ABSTRACT

A hand propelled projectile, for example a throwing knife, having a center of gravity in the handle. A cavity at the side of the handle defining a finger resting surface and protuberances on the surface for engaging the finger as the projectile is thrown. The finger resting surface being off center so as to cause the projectile to spin on its longitudinal axis as it is thrown. In an alternate embodiment, the handle is in two spaced apart parts with the finger resting surface defined on the front part.

13 Claims, 4 Drawing Sheets

HAND PROPELLED LONGITUDINAL AXIAL GYROSCOPIC PROJECTILE

BACKGROUND OF THE INVENTION

The present invention relates to a hand propelled projectile, particularly one that is longitudinally axial and more particularly one that is internally driven by the tip of the thrower's index finger within the volume defined by the outer casing of the projectile. The projectile is hand propelled because it is intended to be thrown by hand. It is internally driven because it is propelled from within the volume defined by the outer casing of the projectile, by the party throwing the projectile, particularly by his finger and more particularly by the tip of his index finger. The projectile is longitudinal axial because it rotates around its longitudinal axis. It is gyroscopic because the stability of its flight relies on gyroscopic action caused by the longitudinal axial rotation of the projectile after it is thrown. Although the type of projectile to which the invention is applied is not restricted, the most usual application for the invention is a throwing knife. Hereafter, a throwing knife will be discussed, but other projectiles adapted to the features of the invention are contemplated as well.

To throw a knife to hit a target situated on a plane, the person throwing the knife may use any of three known methods:

1. The thrower holds the knife blade at a point near its tip when throwing it. With reference to drawing FIG. 1 hereof, the knife travels through the air, spinning about its axis YY', or about another axis within the plane ZY, and the axis of spin passes through the center of gravity of the knife. For a thrown knife, the center of gravity flies through a parabolic pathway within the plane ZX.
2. Instead of holding the blade by the tip, the thrower can hold the knife by its handle. With the knife thrown as described above, it is movable in virtually the same way as the first throwing method.
3. Alternatively, the thrower can rest the knife on the palm of his hand with the point facing forward and can throw the knife with a sliding motion of the hand. The knife is propelled by rotation of the thrower's arm which accelerates the knife through centrifugal force. It is intended that the knife travel through the air like an airplane, with the tip of the blade substantially not wavering from pointing toward the target. However, if there is a deviation between the longitudinal axis of the knife and the velocity vector of the center of gravity, this produces a disturbing torque which exaggerates the deviation and renders the trajectory of the projectile unstable, which reduces the throwing range.

Spears and darts are examples of hand held projectiles which travel through the air with a forward facing tip, that is without revolving about an axis within the plane ZY. The sharp metal tips of both these types of projectile remain pointed toward the target because their center of gravity is in the sharp ended half of the projectile. As a result, the momentum of the force produced by deviation between the knife axis and the velocity of vector of the center of gravity is corrected, tending to align the axis with the velocity vector.

At least three types of hand held projectiles use gyroscopic spin to stabilize their flight. The first type includes spinning discs, such as those used as throwing toys, e.g. plastic spinning discs that are thrown at the beach, or spinning weapons known as Ninja stars. There is stability of the plane of the disc in flight because of the gyroscopic effect of the rotation of the disc. The kinetic momentum vector forms an angle of approximately 90° with the velocity vector of the center of gravity. Therefore these are hand propelled transverse axial gyroscopic projectiles, rather than longitudinal axial projectiles.

The second type are boomerangs, which perform like the discs just discussed with respect to the angle between the kinetic momentum and the velocity of the center of gravity. However, the lack of symmetry of the object and its airplane wing-like profile produce a unique flight path.

Yet another example are spinning balls like rugby balls, which, to the inventor, appear to travel spinning through the air about a longitudinal axis with one end always pointing to the target. The players' fingers or body act on the outer surface of the ball to provide the drive end spin.

Returning to the knives thrown by holding either the tip or holding the handle, the thrown knife rotates about an axis which is perpendicular to the longitudinal axis, that is within the plane ZY. Because the knife is rotating, its point is directed at the target during each revolution for only a fraction of a second. For the knife tip to hit the target, the precise instant of the knife pointing at the target must coincide with the time when the knife point reaches the target, a coordination that is quite difficult to achieve. In the third case where the knife is thrown point forward by centrifugal force, while the knife tip is intended to point continuously at the target, this is difficult to achieve as such motion caused by throwing is mechanically unstable.

SUMMARY OF THE INVENTION

It is an object of the present invention to provide a hand propelled projectile which overcomes the above mentioned disadvantages of the knife tip continually changing its direction and of the flight of the projectile being unstable. According to the invention, a thrower's finger is introduced within the volume defined by the surrounding casing of the handle in order to propel the projectile. This causes the tip of the projectile, e.g. the knife, to constantly point toward the target, and as a result of the friction of the finger with the knife handle during release, the knife leaves the thrower's hand rotating about the longitudinal axis of the knife, as the knife moves forward tracing a straighter parabolically stable trajectory. As a result, the knife is likely to contact the target tip first and to stick in the target.

In particular, the projectile, and particularly the knife, comprises a rear portion, approximately one-half the length of the projectile, which forms the handle or shaft, and a front portion, generally about one-half the length, which when the projectile is a knife, comprises the knife blade. According to the invention, the handle has a cavity, hole or opening on its lateral side that is deep enough that a finger of the thrower fits within the cavity. The cavity has a forward wall, which faces rearwardly, and on that wall is a finger resting surface which is oriented generally perpendicular to the longitudinal axis of the projectile. The finger rest surface may include raised parts or protuberances which position the index finger on the surface. Contact between the index finger and the resting surface causes the knife or projectile to spin about its longitudinal axis when the knife is thrown and released. This is facilitated by the hole or cavity in the handle being so placed and shaped and the finger rest surface being placed as to be radially off-center, which causes the knife to spin when it is released.

Other features and features of the present invention will become apparent from the following description of the preferred embodiment of the invention considered in conjunction with the accompanying drawings:

DESCRIPTION OF PREFERRED EMBODIMENTS OF THE INVENTION

Figure 1:
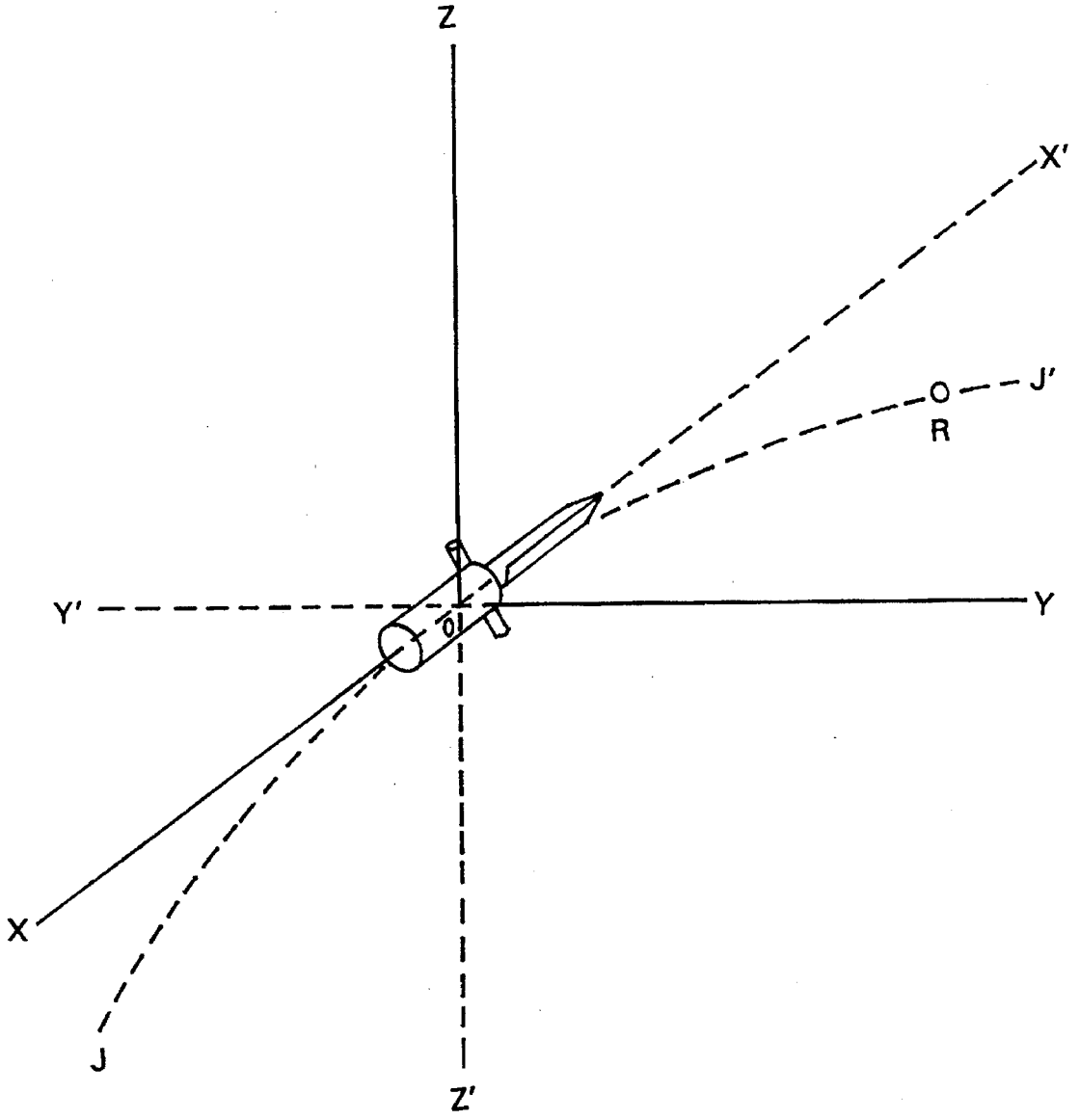
FIG.1 (PRIOR ART)
FIG. 1 schematically shows the path of a conventional knife flying toward a target on the plane ZX.

FIG. 1 shows knife heading toward a target A on the plane ZX. The axis XX' coincides with the longitudinal axis of the knife at the instant depicted in FIG. 1. The three axes OX, OY and OZ are orthogonal to each other and cross the center of gravity of the knife. The center of gravity of the knife follows a trajectory depicted by the general parabola JJ' shown as a dotted line. This depicts the path of the knife and center of gravity shows the normal area where the knife would spin about an axis within plane ZY. The invention is to overcome the spinning of the knife.

The invention is useful with any spindle shaped, perforating, cutting, piercing or blunt object which is required to hammer or strike a target from a distance. These include knives, daggers, clasp knives, punches, etc. A knife is described below.

Figure 2:
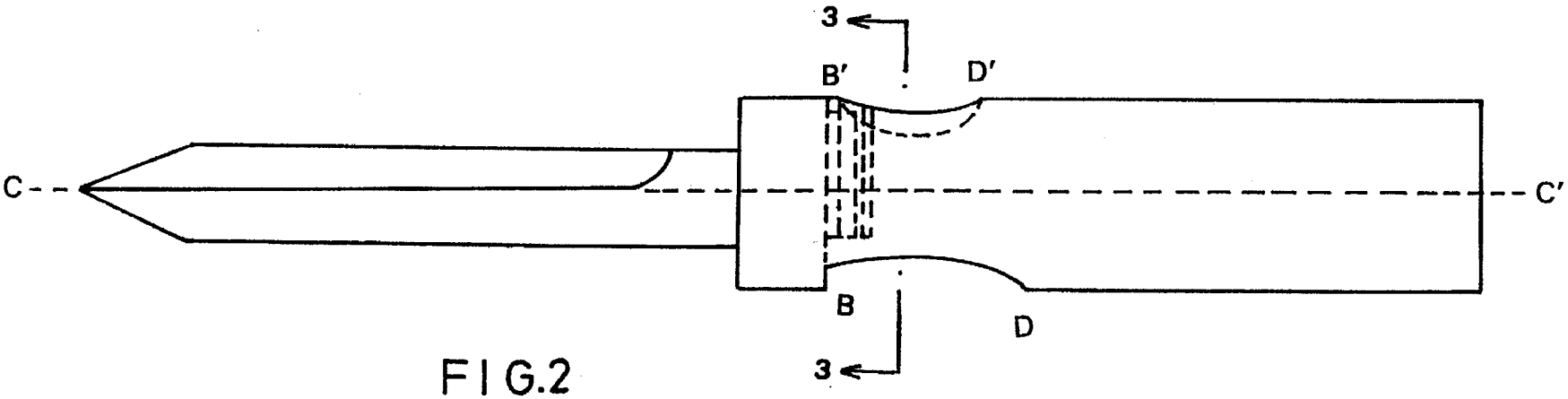
FIG. 2 is a longitudinal cross-section of a hand propelled, internally driven, longitudinal axial gyroscopic throwing knife according to the invention.
Figure 8:
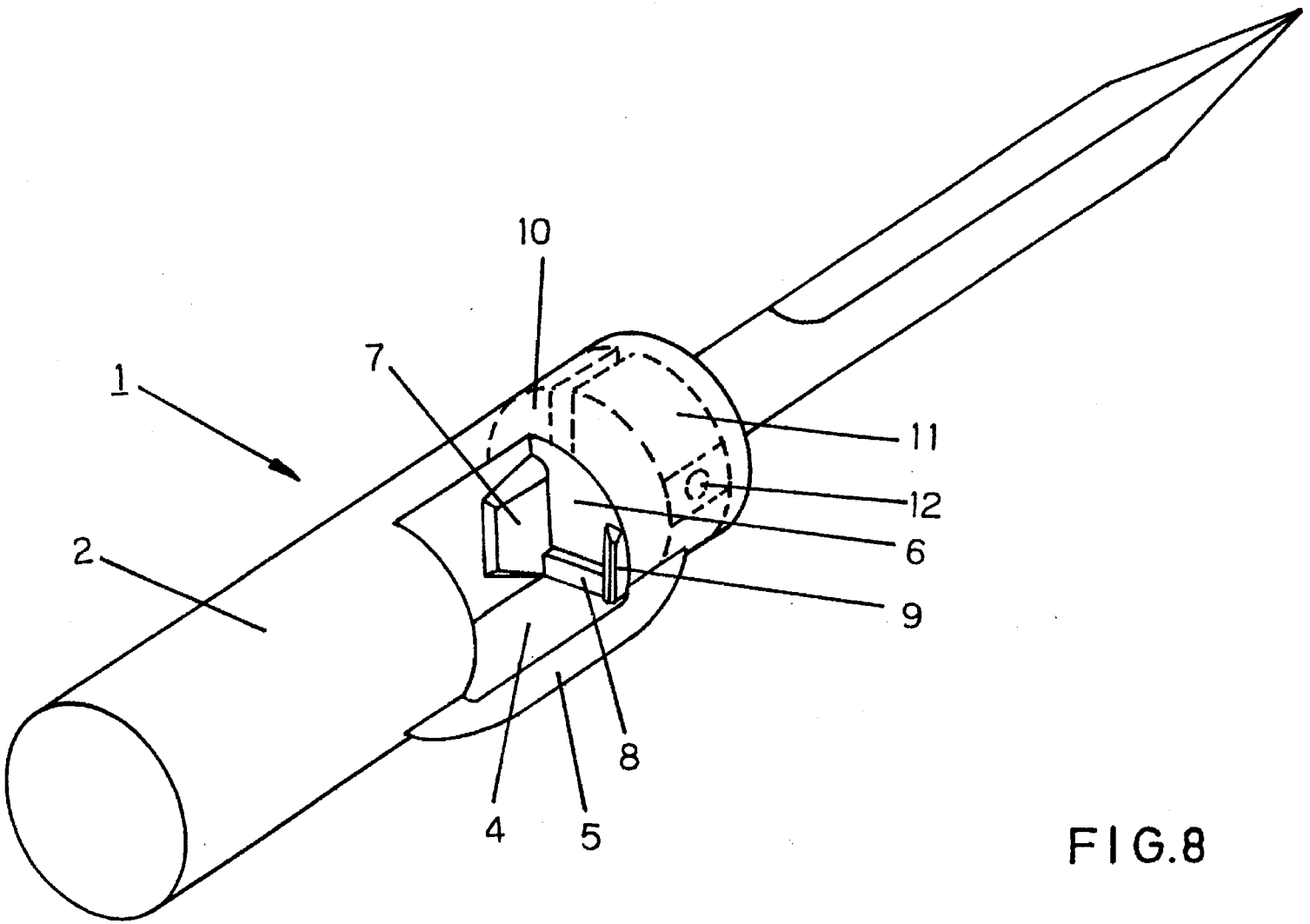
FIG. 8 is a perspective view of the first embodiment of the projectile shown in FIG. 2.

The knife of the invention is shown generally in FIGS. 2 and 8. The cross-section of FIG. 2 shows the longitudinal axial gyroscopic throwing knife. Position BB' indicates the position of the finger rest for the forefinger, which is shown and described below with reference to FIG. 8. BD depicts the lower extreme of the handle cavity and B'D' depicts an upper opening located at the upper extreme of the handle cavity. The knife has a longitudinal axis along the line CC'.

With reference to FIG. 8, the knife or projectile 1 includes a handle 2 generally at the rear half of the knife and a projecting or front part approximately half the length thereof which is shown as the blade 3.

The handle 2 includes a radially open cavity 4 into the side of the handle into which the finger of the thrower may be placed. There is a reinforcement 5 for strengthening the handle.

The open end cavity 4 has a front part comprised of a finger resting surface 6 which faces to the rear of the knife. The surface is oriented substantially perpendicular to the axis CC' of the knife and is located along that axis generally near the center of the knife.

Figure 3:
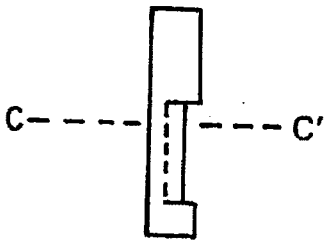
FIG. 3 is a view in the direction of 3—3 of FIG. 2 forwardly in the knife showing the finger rest.
Figure 4:
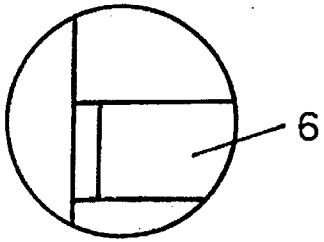
FIG. 4 is a cross-section of FIG. 3.

For user comfort, for causing the user to place his finger properly on the finger rest surface 6 and at the correct orientation, the finger rest surface 6 is preferably bordered by three prismatic shaped raised parts or protuberances, respectively 7, 8 and 9 which define between them a receptacle for the tip of the index finger. The receptacle defined and thus the finger rest surface 6 is off-center from the central longitudinal axis of the projectile, as can be seen in FIGS. 3 and 4. The protuberances 7, 8, 9 are faceted and have different respective heights for guiding the positioning of the finger, with protuberance 7 being the tallest or furthest rearward and protuberance 8 being the shortest. The protuberance 8 offers additional resistance to the finger tip and enhances the spinning momentum, producing a higher rotation speed and greater gyroscopic effect.

The receptacle defined by the protuberance 7, 8 and 9 is meant to position the finger correctly for desired spinning. This effect can be achieved without requiring raised parts. The recess therefore may be provided with different configurations, as in the second embodiment of FIG. 7, which eliminates the outward protuberance 9 of FIG. 8.

Within the front end part of the handle there are two semi-cylindrically shaped counterweights 10 and 11 and the blade 3 is joined to the two counterweights 10, 11 in the handle by the rivet 12. These are shown by broken lines in FIG. 8. The counterweights 10 and 11 are anchored in and sunk into the plastic material of the front part of the handle. The counterweights are supplied and positioned for providing the desired weight for the knife and for positioning the center of gravity of the knife near the finger rest surface.

Figure 5:
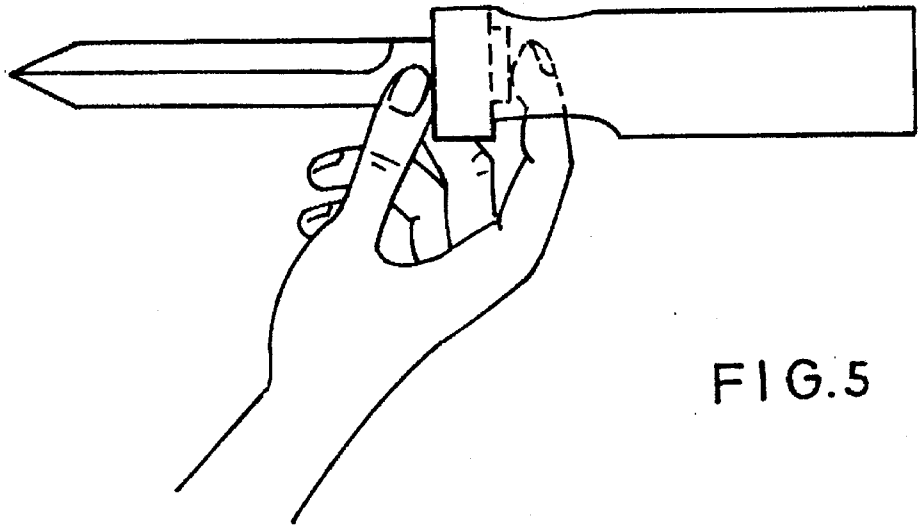
FIG. 5 is a depiction of the knife of FIG. 2 in the throwing position.

The projectile or knife is held in the hand as seen in FIG. 5. The thrower's index finger is introduced into the cavity 4 by being introduced through the lower opening of the handle, generally through opening BD in FIG. 2. The tip of the finger rests on resting surface 6. The upper opening B'D' in FIG. 2 of the handle insures that the end of the thrower's finger does not contact the inside of the outer casing of the handle. If there were no danger of this happening, e.g. because the handle diameter is quite large, the upper opening into the cavity would not be needed. The handle is usually otherwise hollow, although that is not required.

When the projectile is thrown, like one throws a stone, ball, etc., the projectile, that is the knife, flies point forward, while friction between the thrower's finger and the finger rest generates a spinning moment in relation to the longitudinal axis as the thrown knife flies toward the target. When the projectile or knife is released from the hand, it travels with its point facing forward and it is spinning rapidly about its longitudinal axis as it flies toward the target and it flies like a ballistic projectile fired from a rifled barrel. The gyroscopic effect of the spinning stabilizes the trajectory of the projectile so that the projectile tends to arrive at the target point first and so that its longitudinal axis remains approximately tangent to the trajectory described by its center of gravity, assuring a direct hit of the point on the target, however far the target is away from the throwing point.

The invention functions as desired because the projectile is propelled forward from the surface which is a point close to the center of gravity and a point that is out of line with the center of the longitudinal axis. This has the effect of moving the projectile point forward and rotating it about its longitudinal axis at the same time.

Figure 6:
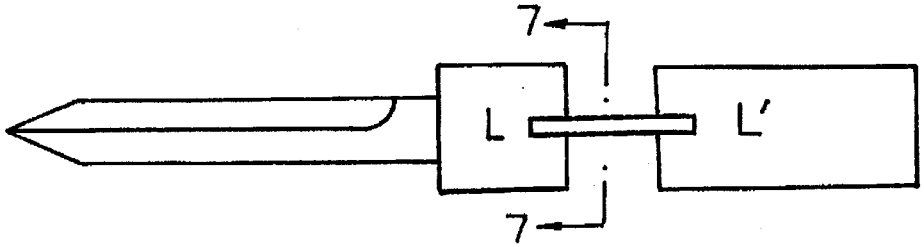
FIG. 6 is a longitudinal cross-section through a second embodiment of a knife according to the invention comprised of two spaced apart joined together pieces.
Figure 7:
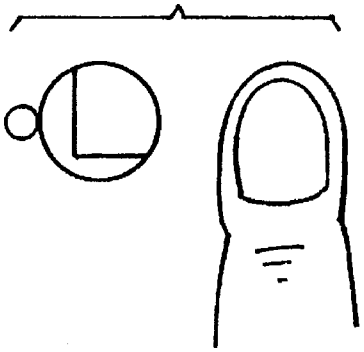
FIG. 7 is a view in the forward direction 7 in FIG. 6 showing the connecting piece between the knife handle portions and the finger rest on the rear side of the forward portion.

The second embodiment of the invention of FIG. 6 is typically used with a smaller knife. The illustrated knife has a blade as discussed above. But, the handle is comprised of two longitudinal direction spaced apart sections, spaced apart far enough to define the cavity in which the thrower's finger is placed. Welded to the outsides of the two handle parts is a connection piece LL'. The position of the connection piece defines the location of the finger rest surface 6 to the side of the connection piece, as can be seen in FIG. 7. As noted above, the finger rest surface in FIG. 7 has two protuberances, but not the radially outer one. These two are sufficient for the finger. In other respects, the knife of FIGS. 6 and 7 has the features of the first embodiment of FIGS. 2 and 8.

The invention has advantages. The tip or striking end points constantly and steadily toward the target as it travels there. Learning the technique of throwing is easier and quicker than with the classical art of knife throwing, particularly where the knife spins around its center of gravity. The projectile weight/range ratio is improved over conventional projectiles and resulting target accuracy is greater.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A hand propelled, internally driven, gyroscopic projectile having a longitudinal axis, the projectile comprising:

a frontally positioned striking part; and a rearwardly positioned handle having a front end and a rear end, the front end being attached to the striking part such that the handle and striking part are axially aligned along the longitudinal axis;

the handle having an open cavity for receiving a thrower's finger, the cavity having a receptacle comprising a finger resting surface for contacting the finger when the projectile is thrown and raised protruberences shaped for positioning the finger on the resting surface during throwing of the projectile, the resting surface being transverse and off center with respect to the longitudinal axis of the projectile such that the thrower's finger contact with the resting surface causes the projectile to rotate around the longitudinal axis and maintains the striking part leading when thrown.

2. The projectile of claim 1, wherein the protuberances are substantially prismatic in shape while the resting surface is substantially flat and perpendicular to the longitudinal axis of the projectile.

3. The projectile of claim 2, wherein the prismatic protuberances include at least one that extends parallel to the length of the finger in the cavity and another that extends transversely to the finger and that is positioned to be engaged by the finger as the finger is moving out of the cavity when the projectile is thrown.

4. The projectile of claim 1, further comprising a counterweight in the handle of a size and weight and so placed as to provide the center of gravity for the projectile in front of the finger resting surface.

5. The projectile of claim 4, wherein the counterweight is comprised of two high density components and the striking part is clamped between those components in the handle.

6. The projectile of claim 1, wherein the handle is comprised of two spaced apart parts and a connecting piece of small cross sectional dimension extending between and connecting the two handle parts; one of the handle parts is a forward part closer to the striking part of the projectile, and the forward handle part having a rear face on which the receptacle is defined.

7. The projectile of claim 1, wherein the striking part of the projectile is selected from the group consisting of a metal blade, metal rod and hammer head.

8. A hand propelled, internally driven, gyroscopic projectile having a longitudinal axis, the projectile comprising:

a frontally positioned striking part; and a rearwardly positioned handle having a front end and a rear end, the front end being attached to the striking part such that the handle and striking part are axially aligned along the longitudinal axis;

the handle having an open cavity positioned towards the front end of the handle for receiving a thrower's finger, the cavity having a receptacle comprising a finger resting surface for contacting the finger when the projectile is thrown, the resting surface being rearwardly facing and transverse with respect to the longitudinal axis of the projectile such that the thrower's finger contact with the resting surface causes the projectile to rotate around the longitudinal axis and maintains the striking part leading when thrown.

9. The projectile of claim 8, wherein the resting surface is positioned in the cavity as to be off the longitudinal axis of the projectile.

10. The projectile of claim 9, wherein the handle is comprised of two spaced apart parts and a connecting piece of small cross sectional dimension extending between and connecting the two handle parts; one of the handle parts is a forward part closer to the striking part of the projectile, and the forward handle part having a rear face on which the receptacle is defined.

11. The projectile of claim 8, wherein the receptacle further comprises raised protuberances shaped for positioning the finger on the resting surface during throwing of the projectile.

12. The projectile of claim 11, wherein the protuberances are substantially prismatic in shape while the resting surface is substantially flat and perpendicular to the longitudinal axis of the projectile.

13. The projectile of claim 9, wherein the protuberances include at lest one that extends parallel to the length of the finger in the cavity and another that extends transverse to the finger and that is positioned to be engaged by the finger as the finger is moving out of the cavity when the projectile is thrown.

* * * * *